US011333311B1

(12) United States Patent
Sorensen et al.

(10) Patent No.: US 11,333,311 B1
(45) Date of Patent: May 17, 2022

(54) LIGHTING SYSTEM WITH CURVING OR TWISTING MODULAR HOUSING

(71) Applicant: ABL IP Holding LLC, Atlanta, GA (US)

(72) Inventors: Christopher J. Sorensen, Denver, CO (US); Christopher D. Slaughter, Littleton, CO (US); Joshua J. Miller, Highlands Ranch, CO (US); Peter K. Nelson, Denver, CO (US); Carl T. Gould, Golden, CO (US); Zachary A. Ingalls, Littleton, CO (US); Benjamin M. Suttles, McDonough, GA (US); Patrick M. Tweel, Atlanta, GA (US); Nicholas A. Ratliff, Crawfordsville, IN (US); Elías Aurelio Romero Saldívar, Nuevo León (MX)

(73) Assignee: ABL IP HOLDING LLC, Atlanta, GA (US)

( * ) Notice: Subject to any disclaimer, the term of this patent is extended or adjusted under 35 U.S.C. 154(b) by 0 days.

(21) Appl. No.: 16/691,515

(22) Filed: Nov. 21, 2019

Related U.S. Application Data

(60) Provisional application No. 62/849,419, filed on May 17, 2019, provisional application No. 62/770,576, filed on Nov. 21, 2018.

(51) Int. Cl.
*F21S 4/24* (2016.01)
*F21S 8/06* (2006.01)
(Continued)

(52) U.S. Cl.
CPC ..... *F21S 4/24* (2016.01); *F21S 2/005* (2013.01); *F21S 8/061* (2013.01); *F21Y 2103/10* (2016.08); *F21Y 2115/10* (2016.08)

(58) Field of Classification Search
CPC ..... F21S 2/00–005; F21S 4/00–28; F21S 8/00–088; F21Y 2103/10; F21Y 2115/10
(Continued)

(56) References Cited

U.S. PATENT DOCUMENTS 4,245,874 A * 1/1981 Bishop ..... H01R 35/02 174/70 B
5,688,035 A 11/1997 Kashima et al.
(Continued)

OTHER PUBLICATIONS

"Knife Edge Wall and Surface Mount", Pose™, Available Online at: www.axislighting.com, Oct. 4, 2019, 4 pages.
(Continued)

*Primary Examiner* — Jason M Han
(74) *Attorney, Agent, or Firm* — Kilpatrick Townsend & Stockton LLP

(57) ABSTRACT

A lighting system includes first and second component housed within respective first and second housings, and a connector. The first housing defines a first substantially rectangular cross-section that extends from a first end to a second end. The first component is capable of emitting light. The second housing defines a second substantially rectangular cross-section. The second substantially rectangular cross-section extends from a third end to a fourth end. The connector connects the second end with the third end. The connector defines a third substantially rectangular cross-section that is substantially identical to the first and second substantially rectangular cross-sections. The third substantially rectangular cross-section extends along a path from the second end to the third end. The path includes at least one curve of at least fifteen degrees between the second end and the third end, and/or, the substantially rectangular cross-section rotates at least fifteen degrees about the path.

18 Claims, 9 Drawing Sheets

(51) Int. Cl.
*F21S 2/00* (2016.01)
*F21Y 103/10* (2016.01)
*F21Y 115/10* (2016.01)

(58) Field of Classification Search
USPC ..... 362/147–150, 217.01–217.17, 218–225, 362/249.02–249.06, 362, 368–375, 457
See application file for complete search history.

(56) References Cited

U.S. PATENT DOCUMENTS

| | | | | |
|---|---|---|---|---|
| 5,848,837 | A | 12/1998 | Gustafson | |
| 6,161,939 | A | 12/2000 | Bansbach | |
| 6,392,342 | B1 | 5/2002 | Parikka | |
| 6,486,790 | B1 | 11/2002 | Perlo et al. | |
| 6,827,456 | B2 | 12/2004 | Parker et al. | |
| 6,945,668 | B1 | 9/2005 | Orlov et al. | |
| 7,108,414 | B2 | 9/2006 | McCollum et al. | |
| 8,029,708 | B2 | 10/2011 | Parker et al. | |
| 8,052,307 | B2 * | 11/2011 | Bak | G02B 19/0071 362/257 |
| 8,092,063 | B2 | 1/2012 | Isoda | |
| 8,152,352 | B2 | 4/2012 | Richardson | |
| 8,498,505 | B2 | 7/2013 | Moore et al. | |
| 8,721,152 | B2 | 5/2014 | Coleman et al. | |
| 8,783,898 | B2 | 7/2014 | Coleman et al. | |
| 8,794,812 | B2 | 8/2014 | Coleman et al. | |
| 8,814,410 | B2 | 8/2014 | McCollum et al. | |
| 8,827,531 | B2 | 9/2014 | Richardson et al. | |
| 8,899,813 | B2 | 12/2014 | McCollum et al. | |
| 9,170,364 | B2 | 10/2015 | Ezell et al. | |
| 9,316,780 | B2 | 4/2016 | Ezell | |
| 9,368,853 | B2 | 6/2016 | Kroening et al. | |
| 9,383,496 | B2 | 7/2016 | Parker et al. | |
| 9,563,006 | B2 | 2/2017 | Ballard et al. | |
| 9,563,007 | B2 | 2/2017 | McCollum et al. | |
| 9,703,031 | B2 | 7/2017 | Sahlhoff et al. | |
| 9,707,641 | B2 | 7/2017 | McCollum et al. | |
| 10,267,504 | B2 * | 4/2019 | Frederiksen | H01R 31/06 |
| 10,544,906 | B1 | 1/2020 | Openiano | |
| 2006/0044824 | A1 | 3/2006 | Chen | |
| 2007/0285941 | A1 | 12/2007 | Ishihara et al. | |
| 2008/0089093 | A1 | 4/2008 | Miller et al. | |
| 2008/0239753 | A1 | 10/2008 | Parker et al. | |
| 2010/0296025 | A1 | 11/2010 | Gourlay | |
| 2011/0285292 | A1 | 11/2011 | Mollnow et al. | |
| 2011/0317421 | A1 * | 12/2011 | So | F21V 7/0008 362/249.02 |
| 2012/0262940 | A1 | 10/2012 | Miyairi et al. | |
| 2013/0010453 | A1 | 1/2013 | Mahowald | |
| 2015/0160395 | A1 | 6/2015 | Sahlhoff et al. | |
| 2015/0176823 | A1 | 6/2015 | Leshniak et al. | |
| 2016/0033704 | A1 | 2/2016 | Sahlhoff et al. | |
| 2016/0033712 | A1 | 2/2016 | Sahlhoff et al. | |
| 2016/0138789 | A1 | 5/2016 | Brown | |
| 2017/0351475 | A1 | 12/2017 | Meersman et al. | |
| 2018/0172257 | A1 | 6/2018 | Hierzer | |
| 2019/0191525 | A1 | 6/2019 | Goldstein et al. | |
| 2019/0191534 | A1 | 6/2019 | De Bruycker et al. | |
| 2019/0264882 | A1 | 8/2019 | Gomez Martinez et al. | |

OTHER PUBLICATIONS

U.S. Appl. No. 16/814,510 , Notice of Allowance, dated Aug. 2, 2021, 8 pages.
U.S. Appl. No. 15/930,792, Non-Final Office Action dated Jun. 3, 2021, 21 pages.
U.S. Appl. No. 15/930,792 , Final Office Action, dated Sep. 10, 2021, 25 pages.

* cited by examiner

LIGHTING SYSTEM WITH CURVING OR TWISTING MODULAR HOUSING

CROSS-REFERENCE TO RELATED APPLICATIONS

This application is a nonprovisional application of, and claims the benefit of priority to, U.S. Provisional Patent Application No. 62/770,576, filed 21 Nov. 2018, and U.S. Provisional Patent Application No. 62/849,419, filed 17 May 2019. Both of the above-identified provisional patent applications are incorporated herein by reference in their entireties for all purposes.

BACKGROUND

Many architectural spaces feature lighting systems that are suspended from structural supports, sometimes in the context of a grid-based dropped ceiling system, and sometimes not. Practical and aesthetic needs exist for further improvements in lighting systems.

SUMMARY

In one or more embodiments, a lighting system includes a first component housed within a first housing, a second component housed within a second housing, and a connector. The first housing defines a first rectangular cross-section that extends, linearly and without rotating, along a first axial direction from a first end to a second end, the first axial direction being transverse to the first rectangular cross-section. The first component is capable of emitting light. The second housing defines a second rectangular cross-section that is substantially identical to the first rectangular cross-section. The second rectangular cross-section extends, linearly and without rotating, along a second axial direction from a third end to a fourth end, the second axial direction being transverse to the second rectangular cross-section. The connector connects the second end with the third end. The connector defines a third rectangular cross-section that is substantially identical to the first rectangular cross-section. The third rectangular cross-section extends along a path from the second end to the third end, wherein (a) the path includes at least one curve of at least fifteen degrees between the second end and the third end, and/or, (b) the rectangular cross-section rotates at least fifteen degrees about the path.

In one or more embodiments, an apparatus for coupling with wiring is provided. The wiring includes an outer jacket and inner wiring, to provide mechanical support and power or signal conductivity for a load. The apparatus includes an upper member that forms an aperture therethrough, and a lower member that forms an aperture therethrough and is adapted to couple with the upper member. When the lower member couples with the upper member, the lower member and the upper member are configured to couple with the outer jacket, so that weight of the lower member, the upper member and the load transfers to the outer jacket. Also, the aperture formed by the lower member and the aperture formed by the upper member align so that the inner wiring can pass directly through the apparatus without bearing the weight of the lower member, the upper member and/or the load.

In one or more embodiments, a ribbon cable includes: one or more cables capable of supporting weight of at least a portion of a luminaire; two or more wires to provide electrical power and/or control functionality to the luminaire; and an outer jacket that encases the one or more cables and the two or more wires. The one or more cables and the two or more wires are aligned in a single row.

In one or more embodiments, a ribbon cable includes two or more wires, and an outer jacket that encases the two or more wires. The outer jacket forms one or more lengthwise apertures that are configured to engage one or more cables capable of supporting weight of at least a portion of a luminaire.

In one or more embodiments, a wiring apparatus includes a substantially planar first member and a second member. The first member includes a plurality of wire holders configured to engage a corresponding plurality of insulated wires, the plurality of wire holders being arranged transversely to a lengthwise direction of the plurality of insulated wires, each of the wire holders being arranged at known spacings therebetween. The first member also includes one or more retaining features. The second member includes a planar printed circuit board ("PCB") arranged in face to face opposition to the substantially planar first member, circuitry and/or light emitters coupled with a face of the PCB that faces away from the substantially planar first member, and a plurality of electrical connectors electrically connected with the PCB, and arranged on a face of the PCB that faces toward the substantially planar first member at the known spacings of the wires. When the second member is brought into proximity with the first member, each of the electrical connectors is configured to cut through insulation of the insulated wires to make an electrical connection between each insulated wire and the corresponding electrical connector, and the one or more retaining features engage with the PCB so as to hold the second member in place with respect to the first member.

BRIEF DESCRIPTION OF THE DRAWINGS

The present disclosure is described in conjunction with the appended figures.

DETAILED DESCRIPTION

Figure 1:
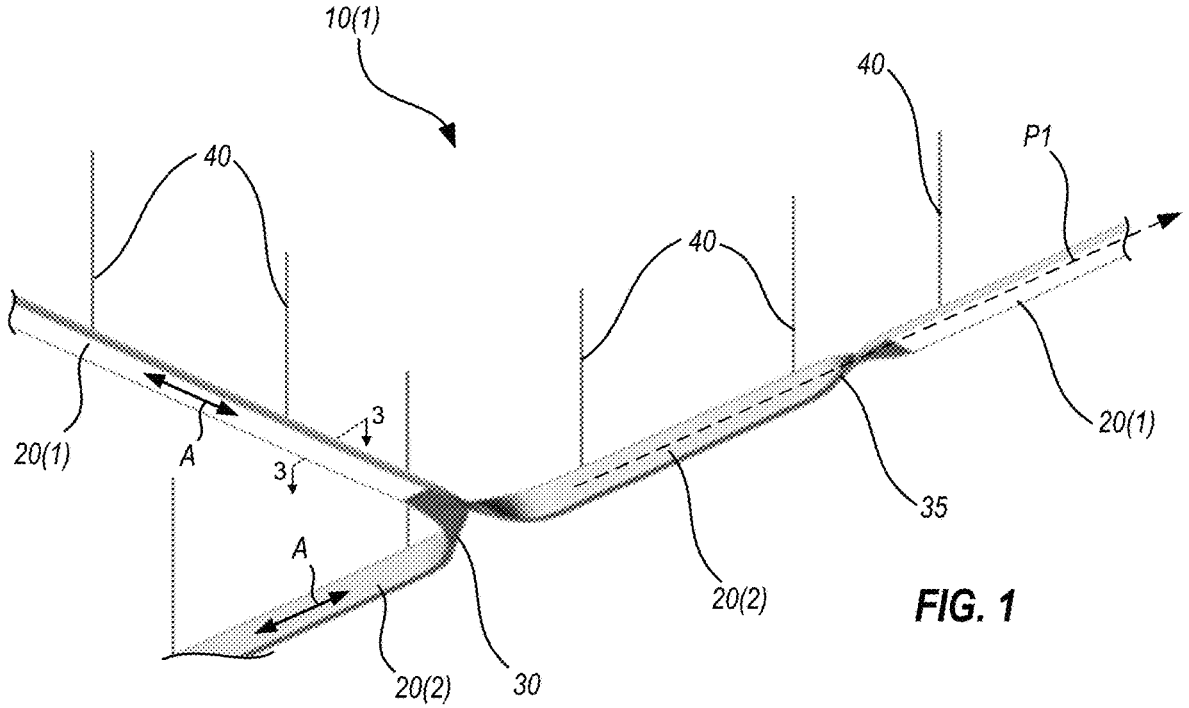
FIG. 1 illustrates a lighting system with a curving or twisting modular housing, in accord with one or more embodiments.

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. Specific instances of an item may be referred to by use of a first numeral followed by a second numeral within parentheses (e.g., luminaire sections 20(1), 20(2), etc.) while numerals not followed by a second numeral within parentheses refer to any such item (e.g., luminaire sections 20). In instances where multiple instances of an item are shown, only some of the instances may be labeled, for clarity of illustration.

Embodiments herein provide new and useful suspended lighting fixtures and methods. Several embodiments are contemplated and will be discussed, but embodiments beyond the present discussion, or intermediate to those discussed herein are within the scope of the present application.

Embodiments herein are related to the idea that luminaire sections, and/or connecting sections (or simply "connectors" herein) that join them, can be based on a long, slim form factor. The luminaires and/or connectors may provide a single unit that spans part or all of an illuminated space, or there may be separate units within a space. The luminaire sections may be linear, curved and/or twisted, and the connectors can be designed to join the luminaire sections through further twists or curves, giving the overall visual impression of a single strip, band, ribbon or the like. The form factor may be, for example, a linearly projected (e.g., extruded) profile, but can also be a profile that curves and/or twists along a direction that is transverse to the profile. That is, the luminaire sections and/or connectors can either be straight, or may curve or twist, in any direction. These embodiments provide a lighting designer with the freedom to join units with angles, curves and/or twists in any direction, sufficient to create installations that provide useful area, volume, task, spot, wallwash or other targeted lighting patterns, while maintaining visual continuity across an illuminated space.

Luminaire sections and/or connectors can have rectangular or other cross-sectional profiles, such as a rectangular profile with rounded corners or sides, an oval profile, a triangular or truncated triangular profile, and others. A rectangular profile may, for example, have an aspect ratio of 1:1 (i.e., square), 2:1, 3:1, 4:1, 5:1, 6:1 or 8:1, or an aspect ratio intermediate to those listed. A direction that is transverse to the cross-sectional profile is considered a lengthwise or axial direction herein, and the luminaire section or connector will be said to extend along this direction, despite the fact that the luminaire section or connector may curve and/or twist, as well. Corners of rectangular profiles may be square, slightly rounded, or so fully rounded that one or more smaller sides of the rectangular profile form a continuous curve. Corners may be rounded to different degrees along different sides of the profile. For example, a "D" shape may be provided by fully rounding one side of the profile while leaving the other side of the profile straight.

A "substantially rectangular" profile is a subset of the profiles discussed above, that provides an interesting visual appearance, geometric continuity from place to place within an installation, and is relatively practical to manufacture. "Substantially rectangular" means herein that a luminaire portion (e.g., a housing of a portion of a luminaire that emits light, or all or part of a connector joining such portions together) can be bounded by four side segments that form a rectangular outline, with the housing portion including side structures that coincide with two parallel, opposing shorter ones of the side segments for at least 75% of the width of the two opposing shorter ones of the side segments, substantially from end to end of the housing portion. In this sense, "coincides with" means that edges of the side structures extend along the two opposing shorter ones of the side segments, with the exception of normal manufacturing tolerances, finishes and/or minor fasteners. "Substantially from end to end" means herein that the substantially rectangular cross-section is formed by the housing at each end of the housing portion, and for at least 75% of the length of the housing portion. The housing portion may include at least some center structure connecting the side structures, but the center structure need not be continuous along the length of the housing portion. The center structure does not extend outside the rectangular outline with the exception of normal manufacturing tolerances, finishes and/or fasteners. The minimums of 75% for widths of side structures that extend along the two opposing shorter ones of the side structures that are considered "substantially rectangular," and for lengths of a housing portion that are "substantially rectangular" along a total length of the housing portion, are minimum percentages that are considered to provide a clean "rectangular" look for the housing portion. Housing portions herein are observed to provide a more polished look when these minimums are raised to 80%, and still more polished at 85%. Above 85% or 90%, an observer may not notice differences in the rectangularity of housings, or continuity of housings' rectangularity along their lengths. Nevertheless, the present disclosure contemplates housings with widths of side structures that extend along the two opposing shorter ones of the side structures along 75%, 80%, 85%, 90%, 95% or 100%, or values intermediate to the values listed, of the total widths of the shorter sides.

Light may be emitted from one or more sides of luminaire sections. The luminaire sections can emit light uniformly from a region, or the light can be directed either by optics integrated with the luminaire sections, and/or by the fact that the luminaire sections are oriented differently. For example, a first luminaire section may emit light downwardly. Another luminaire section may be oriented toward a wall, to provide a wall wash light distribution. In this case, two opposing longer segments of a substantially rectangular profile (e.g., the "long side" of the profile) may be within fifteen degrees of vertical. That is, the light emitting face may not be exactly vertical, but can be within a fifteen degree range of vertical, to accommodate manufacturing tolerances, intentional or unintentional skews in installation, or for aesthetic reasons. Yet another luminaire section may be oriented toward a ceiling, providing upwardly directed light for indirect lighting. In any of these configurations, light-emitting sections can emit light as generated by a light emitter, or as shaped by optics to narrow, widen, focus, diffuse, aim or otherwise redirect a net light distribution. Luminaire sections need not be identical within an installation, and the luminaire sections described above need not all be present within an installation.

Luminaire sections herein may use any type of light emitter, such as incandescent bulbs, fluorescent bulbs, or light-emitting diodes (LEDs). In many embodiments herein, LEDs are advantageous due to their small size, high efficiency and availability in various colors, including "white" LEDs (for example, packaged devices that combine light from various colors of LED chips, and/or use phosphors or the light to produce longer wavelengths of light from short wavelength LED chips). Similarly, optics of any known type may be used, including without limitation, lenses, diffractive elements, reflectors, light guides, light redirecting films, diffusers, clear cover plates and the like. A light guide may take input light at one or more points (for example a row of LED chips acting as a line source along one edge of the light guide), and generally contain the light by total internal reflection. Light extracting elements can be used to scatter the light out of the light guide in desired locations and into desired directions.

Connecting sections (sometimes simply called "connectors" herein) between luminaire sections may be straight, curved, and/or twisted. Connectors can also provide visually rectilinear forms such as linear dovetail connections, corner dovetail connections, straight corners, flat T connections, dovetail T connections, and the like. The connectors can provide connectivity for power wiring and/or control wiring among luminaire sections, so that a given system need not require connection to power and controls, except at a single location—which location can also be made without visible wires, by abutting a floor, wall or ceiling, or by integrating power and/or control wiring within support cables (see, e.g., FIGS. 18A, 18B and the supporting description herein). Connectors may connect two, three, four or more luminaire sections, and/or other connectors. Connectors may connect luminaire sections that lie in a single plane (e.g., near or parallel to a ceiling) and/or may provide ways to join luminaire sections that extend along any direction. For example, a first luminaire section may extend horizontally, and a connector may connect the first luminaire section with a second luminaire section that extends vertically or diagonally. Typically, at least two components will be connected through a connector that forms at least one of a twist or a turn. In the case of turns, the turn may be at least 15 degrees, and possibly 20, 25, 30, 35, 40, 45, 50, 55, 60, 65, 70, 75, 80, 85, 90, 95 degrees or more, or a value intermediate to those listed. In the case of twists, the twist may be at least 15 degrees, and possibly 20, 25, 30, 35, 40, 45, 50, 55, 60, 65, 70, 75, 80, 85, 90, 95 degrees or more, or a value intermediate to those listed. Luminaires may be manufactured in seamless integrated form with one or more connectors. In certain embodiments, two or more than two luminaire sections will be joined with connectors to form a system with many twists, turns, branches and the like.

Systems formed of luminaire sections and connectors as described herein can visually fill or complement a volume within an illuminated space in a variety of ways. In some embodiments, luminaire sections can be confined to a given vertical height, and can be connected so as to provide a feeling of a virtual ceiling within a volume, circumscribe a perimeter of the space, or the like. In other embodiments, twisting and/or curving connectors can be used to arrange luminaire sections at various heights within the volume, to provide a visual impression of "filling" the volume with light. Odd shaped volumes (e.g., areas where multiple levels adjoin a space with a vaulted ceiling, and/or volumes that cannot be well categorized as having "levels" at all) can also be advantageously provided with lighting luminaire sections and connectors that fill portions of the volume, or all of the volume, as desired.

FIG. 1 schematically illustrates a lighting system 10(1) with a twisting modular housing, in accord with one or more embodiments. Lighting system 10(1) includes luminaire sections 20, of which two sections 20(1) are oriented horizontally with light-emitting areas 22 facing downward. The other two luminaire sections 20(2) are oriented vertically such that light emitting areas (if any) face away from the viewer. Luminaire sections 20 are connected with connectors 30 and 35, as illustrated. An axial direction A is noted with respect to some luminaire sections 20(1) and 20(2), but not noted in all luminaire sections shown in FIG. 1, for illustrative clarity. Each luminaire section 20 in FIG. 1 forms a substantially rectangular cross section transverse to its own axial direction. A sight line 3-3 in FIG. 1 shows a location within one luminaire section 20(1) at which the cross-sectional view of FIG. 3 is taken.

In lighting system 10(1), connector 30 is a twisting "Y" connector that connects three luminaire sections, while connector 35 is a twisting connector that connects only two luminaire sections. Lighting system 10(1) is suspended from some mechanical support (e.g., a ceiling, not shown in FIG. 1) by suspension cables 40. An exemplary path P1 is shown as beginning within one luminaire section 20(2), continuing through one connector 35, and ending within one luminaire section 20(1). Path P1 can be considered to define an axial direction along luminaire sections 20(1) and 20(2), and through connector 35. Path P1 undergoes a ninety degree rotation within connector 35 so that a cross-section of each end of connector 35 matches in shape and orientation relative to ends of luminaire sections 20(1) and 20(2) where they connect with connector 35. When a lighting system herein forms a twisted path like path P1, a connector 35 generally provides a twist of fifteen degrees or more.

Figure 2:
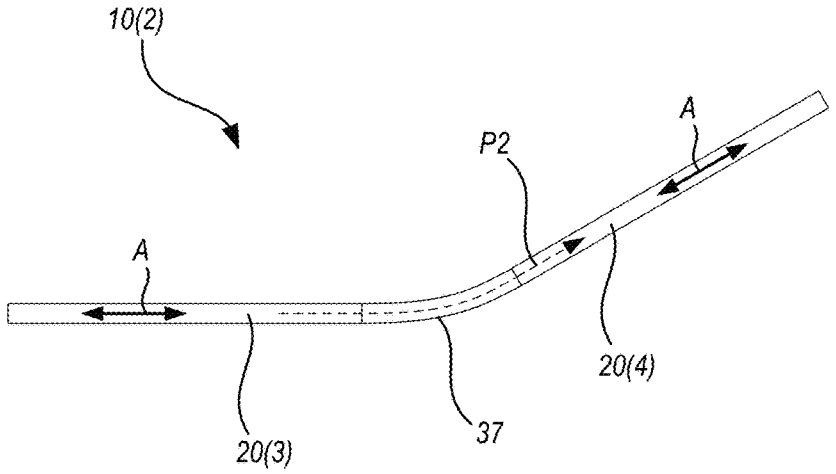
FIG. 2 schematically illustrates a lighting system with a curving modular housing, in accord with one or more embodiments.

FIG. 2 schematically illustrates a lighting system 10(2) with a curving modular housing, in accord with one or more embodiments. Lighting system 10(2) includes luminaire sections 20(3) and 20(4), of which one or both may be light-emitting. However, in these embodiments the light-emitting faces are not visible, as they are on the top or bottom faces of sections 20(3) and 20(4), perpendicular to the plane of FIG. 2. Luminaire sections 20(3) and 20(4) in system 10(2) are connected by a connector 37 that defines a curve, so that a first axial direction defined by luminaire section 20(3) is different from a second axial direction defined by luminaire section 20(4). An exemplary path P2 is shown as beginning along the first axial direction within luminaire section 20(3), continuing through connector 37, and ending along the second axial direction within luminaire section 20(4). Path P2 undergoes a thirty degree curve within connector 37 so that a cross-section of each end of connector 37 matches in shape and orientation relative to ends of luminaire sections 20(3) and 20(4) where they connect with connector 37. Because FIG. 2 is a side view, that is, the long side of the rectangular profile is perpendicular to the plane of the drawing, connector 37 will have a geometry wherein opposing wider faces of connector 37 curve so as to make one of the wider faces longer than the other, and opposing shorter faces of connector 37 curve, but remain the same length as one another. For example, the upper face of connector 37, as illustrated in FIG. 2, will be longer than the lower face. When a lighting system herein forms a curved path like path P2, a connector 337 generally provides a curve of fifteen degrees or more. Of course a connector can also have both a twist and a curve. An axial direction A is noted with respect to luminaire sections 20(3) and 20(4) and is different for the two luminaire sections due to their being connected through connector 37.

Figure 3:
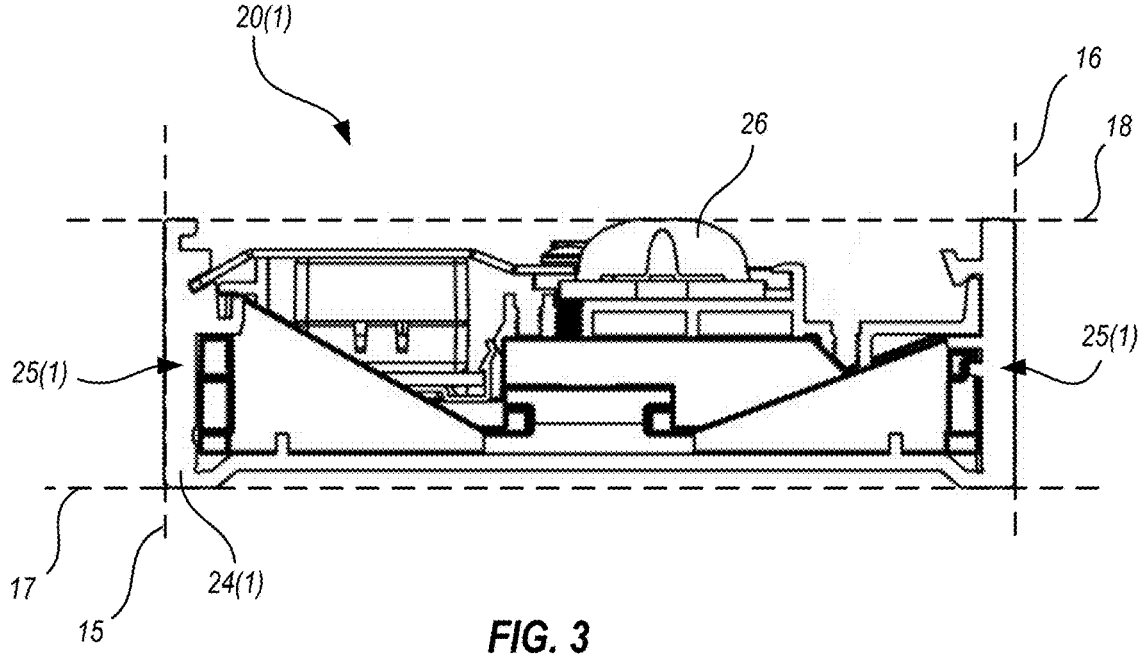
FIG. 3 schematically illustrates one luminaire section shown in FIG. 1, in a cross-sectional view, in accord with one or more embodiments.
Figure 4:
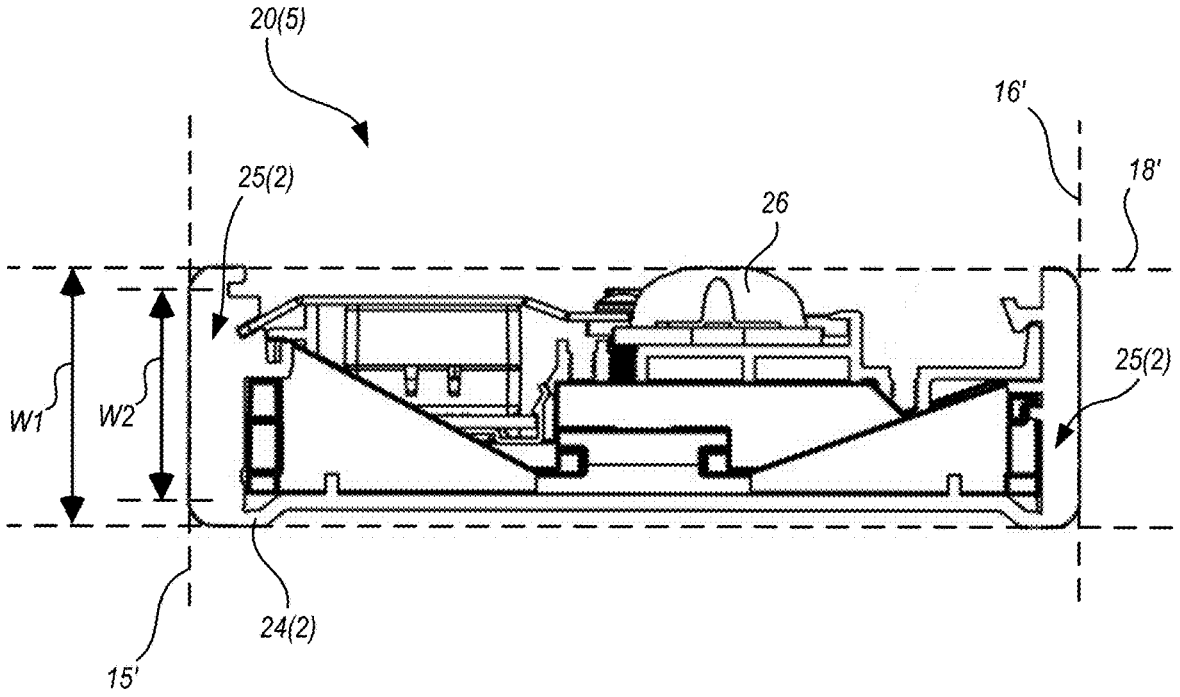
FIG. 4 schematically illustrates another luminaire section, in a cross-sectional view, in accord with one or more embodiments.

FIGS. 3 and 4 schematically illustrate, in cross-sectional views, two luminaire sections with "substantially rectangular" profiles. FIG. 3 schematically illustrates luminaire section 20(1), in a cross-sectional view taken at sight line 3-3 in FIG. 1. Luminaire section 20(1) includes exemplary components such as a housing 24(1) that forms side structures 25(1) at each side, an optic 26, and others. Luminaire section 20(1) fits within four side segments 15, 16, 17 and 18, as shown. Side segments 15 and 16 are opposing, parallel shorter ones of the side segments, and side segments 17 and 18 are opposing, parallel longer ones of the side segments. As discussed above, because side structures 25(1) coincide with side segments 15 and 16 for at least 75% of their respective widths, luminaire section 20(1) is said to be substantially rectangular. Note that the condition of coinciding with the side segments applies only to the opposing, parallel shorter ones of the side segments, and not to the opposing, parallel longer ones of the side segments. It can be desirable to not limit the opposing, parallel longer ones of the side segments to this condition for a variety of reasons. For example, the side of housing 24(1) that faces side segment 17 is actually recessed (e.g., is not coincident with side segment 17) for much of its length. This may be for manufacturing, aesthetic, handling, and/or optical reasons. One particular reason for recessing this surface is that the side of housing 24(1) that faces side segment 17 may be a light emitting surface; recessing this surface relative to the outer edges will help protect it from scratches, fingerprints and debris during manufacturing and installation. Also, as shown in FIG. 3, housing 24(1) does not, and need not extend about certain components (such as optic 26). Thus, all of side segments 15, 16, 17 and 18 are defined as those parallel line segments that at least form an outer boundary for all components of a corresponding luminaire section, irrespective of type or shape of the components.

FIG. 4 schematically illustrates another luminaire section 20(5), in a cross-sectional view. Luminaire section 20(5) includes exemplary components such as a housing 24(2) that forms side structures 25(2) at each side, an optic 26, and others. Luminaire section 20(5) fits within four side segments 15', 16', 17' and 18' (e.g., those parallel line segment that at least form an outer boundary for all components of luminaire section 20(5)), as shown. Comparing features of luminaire section 20(5) with similar features of luminaire section 20(1), it can be seen that side structures 25(2) are a little wider that side structures 25(1), and side structures 25(2) have substantially rounded corners. This reduces the width of side structures 25(2) that are coincident with side segments 15', 16'. However, luminaire section 20(5) still forms a substantially rectangular cross-section, because width W2, taken along the segment where side structure 25(2) is actually coincident with side segments 15', 16' (that is, excluding the rounded corners) is about 82% of width W1, taken at the outer extents of all structure of section 20(5).

Figure 5:
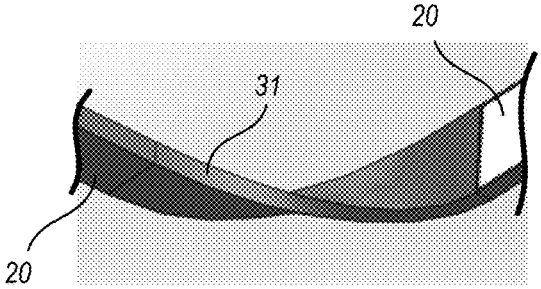
FIG. 5 schematically illustrates a twisting and curving connector with a right-hand twist, in accord with one or more embodiments.
Figure 6:
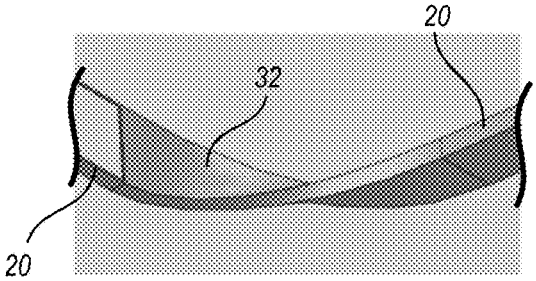
FIG. 6 schematically illustrates a twisting and curving connector with a left-hand twist, in accord with one or more embodiments.
Figure 7:
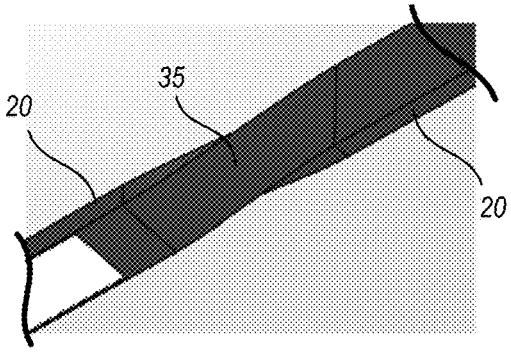
FIG. 7 schematically illustrates the twisting connector of FIG. 1, in accord with one or more embodiments.
Figure 8:
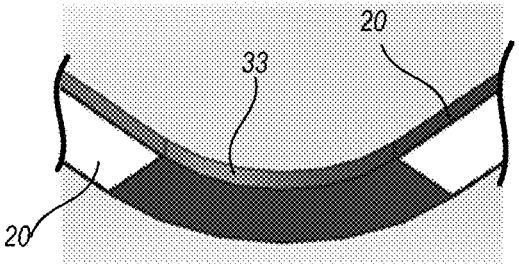
FIG. 8 schematically illustrates a curving connector that makes a flat ninety degree curve, in accord with one or more embodiments.
Figure 9A:
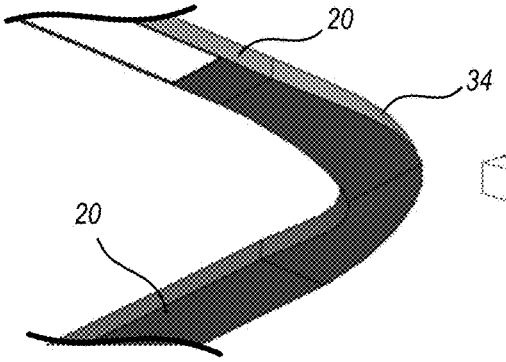
FIG. 9A schematically illustrates a curving connector that makes a banked ninety degree curve, in accord with one or more embodiments.
Figure 9B:
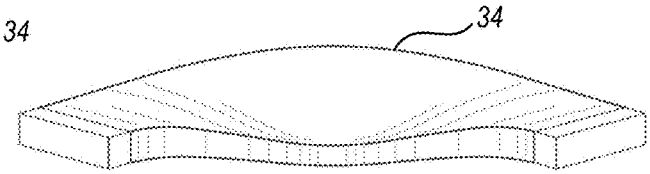
FIG. 9B is an alternate view of the curving connector of FIG. 9A.

Connectors between two luminaire sections herein can take many shapes. For example, FIG. 5 schematically illustrates a twisting and curving connector 31 with a right-hand twist. Connector 31 forms the same substantially rectangular cross-section as adjacent luminaire sections 20. FIG. 6 schematically illustrates a twisting and curving connector 32 with a left-hand twist. Connector 32 also forms the same substantially rectangular cross-section as adjacent luminaire sections 20. FIG. 7 schematically illustrates twisting connector 35 (which is also illustrated in FIG. 1). Connector 35 also forms the same substantially rectangular cross-section as adjacent luminaire sections 20. FIG. 8 schematically illustrates a curving connector 33 that makes a flat ninety degree curve, that is, the long sides of its cross-sectional shape sweep through a plane instead of forming angles with respect to the cross-section at its ends. Connector 33 also forms the same substantially rectangular cross-section as adjacent luminaire sections 20. FIG. 9A schematically illustrates a curving connector 34 that makes a banked ninety degree curve, that is, the long sides of its cross-sectional shape form an angle with respect to the cross-section at its ends. Connector 34 also forms the same substantially rectangular cross-section as adjacent luminaire sections 20. FIG. 9B is an alternate view that schematically illustrates the curving connector shown in FIG. 9A, to better show the banked turn between the ends of the connector. In each of connectors 31, 32, 33, 34 and 35, the connector forms the same substantially rectangular cross-section as adjacent luminaire sections 20, so that the cross-section of the respective connectors can match the cross-sections of luminaire sections 20 where they connect.

Connectors 31, 32 and 33 are also schematically illustrated in commonly-owned U.S. Design Patent Applications Nos. 29/671,054, 29/671,053, and 29/671,052 respectively, which are incorporated by reference herein in their entireties for all purposes.

Figure 10:
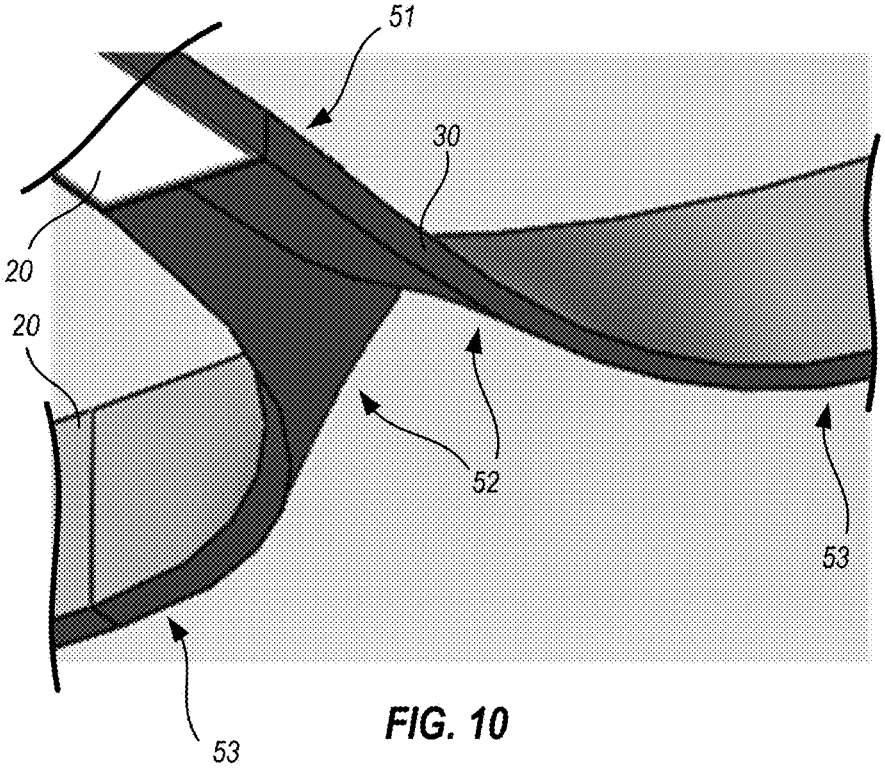
FIG. 10 schematically illustrates the three-way connector of FIG. 1, in accord with one or more embodiments.
Figure 11:
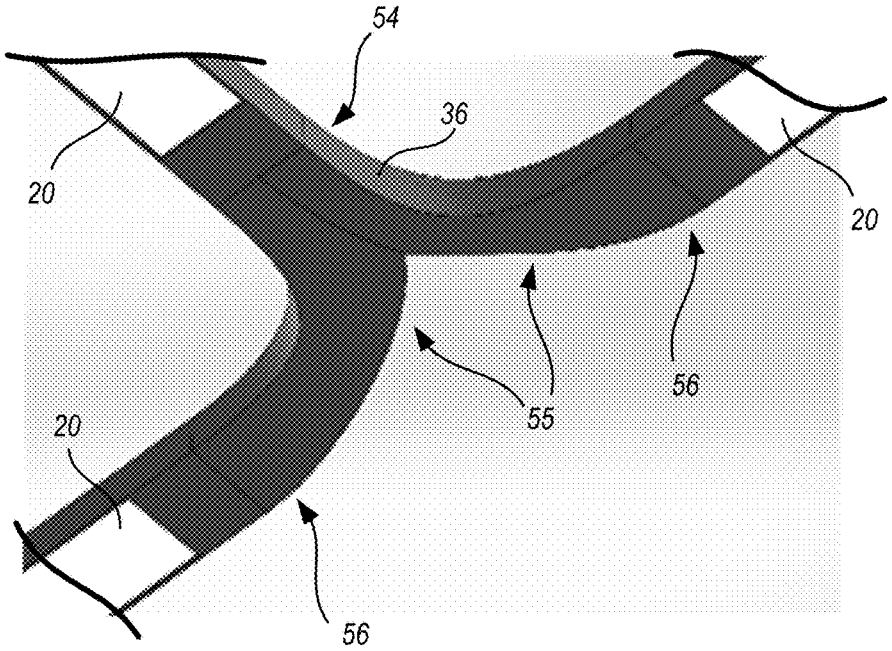
FIG. 11 schematically illustrates another three-way connector, in accord with one or more embodiments.

Connectors among three or more luminaire sections are also possible and can take many shapes. For example, FIG. 10 schematically illustrates a three-way connector 30 (which is also illustrated in FIG. 1). Connector 30 forms the same substantially rectangular cross-sections at its ends, as each adjacent luminaire section 20. A first end 51 of connector 30 couples with one adjacent luminaire section 20. Leading away from first end 51, connector 30 splits into two branches 52, each of which curves, twists and widens until reaching second and third ends 53, each of which couples with other luminaire sections 20. FIG. 11 schematically illustrates a three-way connector 36. Connector 36 forms the same substantially rectangular cross-sections at its ends, as each adjacent luminaire section 20. A first end 54 of connector 30 couples with one adjacent luminaire section 20. Leading away from first end 54, connector 30 splits into two branches 55, each of which curves and widens until reaching second and third ends 56, each of which couples with other luminaire sections 20. Of course, other connector geometries are possible, including those that connect more than three luminaire sections, and/or form straight segments from luminaire coupling ends to a central joining section, and/or join at different angles than those illustrated, and/or include multiple twists and/or curves, and the like. One of ordinary skill in the art, upon reading and comprehending the present disclosure, will conceive of many possible substitutions, equivalents and alternatives, all of which are within the scope of this disclosure.

Figure 12:
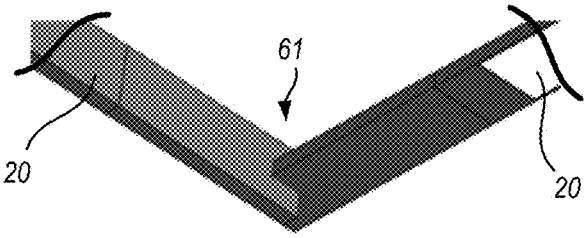
FIG. 12 schematically illustrates a connector that couples a first luminaire section in one orientation, with a second luminaire section that emits at a ninety degree angle with respect to the first, in accord with one or more embodiments.
Figure 13:
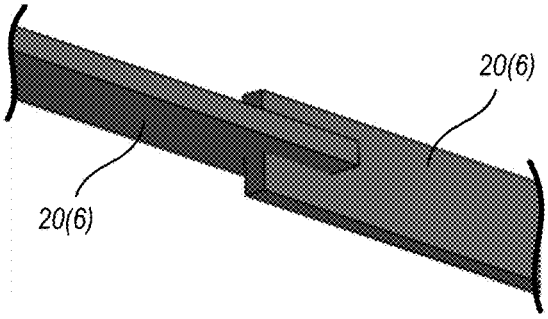
FIG. 13 schematically illustrates two luminaire sections with slots in ends thereof such that one luminaire section can be in a first orientation, and the second luminaire section along the same axial direction, can be in a second light emitting orientation, in accord with one or more embodiments.
Figure 14:
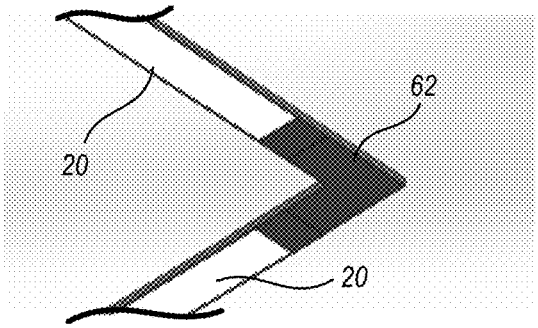
FIG. 14 schematically illustrates a connector that couples first and second luminaire sections that have the same light emitting orientation, but whose axial directions are ninety degrees different, in accord with one or more embodiments.
Figure 15:
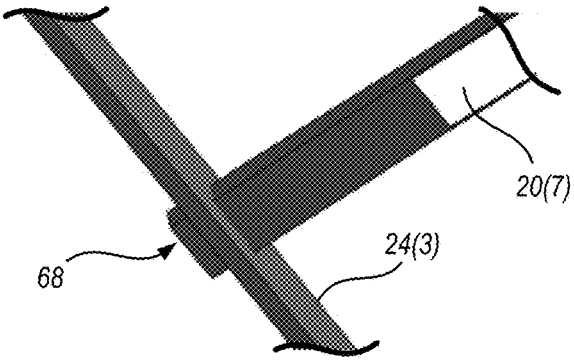
FIG. 15 schematically illustrates a luminaire section that has a large, non-light-emitting region at one end, extending through and coupling with a housing, in accord with one or more embodiments.
Figure 16:
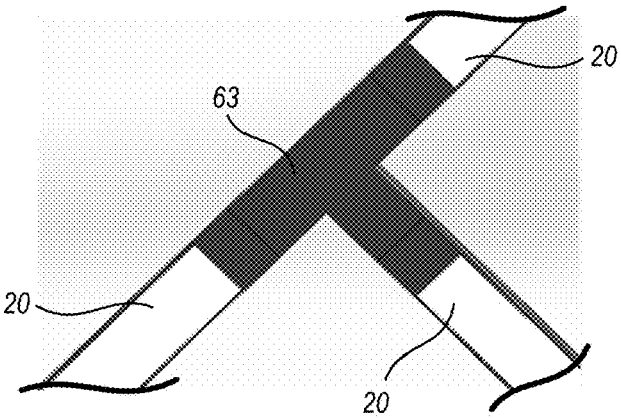
FIG. 16 schematically illustrates a three way connector connecting three luminaire sections, in accord with one or more embodiments.

FIGS. 12 through 16 schematically illustrate other possible connectors for, and ways to couple, luminaire sections having substantially rectangular cross-sections. The connectors and ways to couple luminaire sections shown in FIGS. 12 through 16 may be preferred for certain architectural spaces. In some cases a connector component is used, while in other cases, luminaire sections themselves directly couple with other luminaire sections. FIG. 12 schematically illustrates a connector 61 that couples a first luminaire section 20 in one orientation (e.g., one that emits downward within an architectural space) with a second luminaire section 20 that emits at a ninety degree angle with respect to the first. Axial directions of the two luminaire sections 20 are also ninety degrees different. Both the angular and light emitting angles may differ from those shown. FIG. 13 schematically illustrates two luminaire sections 20(6) with slots in ends thereof such that one luminaire section 20(6) can be in a first orientation, and the second luminaire section 20(6) along the same axial direction, can be in a second light emitting orientation. Thus, like the case shown in FIG. 12, the second luminaire section 20(6) emits at a ninety degree angle with respect to the first (the light emitting surfaces are both hidden in FIG. 13). FIG. 14 schematically illustrates a connector 62 that couples first and second luminaire sections 20 that have the same light emitting orientation (e.g., both emit downward within an architectural space) but whose axial directions are ninety degrees different. FIG. 15 schematically illustrates a luminaire section 20(7) that has a large, non-light-emitting region 68 at one end, extending through and coupling with a housing 24(3). Housing 24(3) may be a housing of a luminaire section as described herein, or a housing for a non-light-emitting segment that is provided for mechanical and electrical continuity within an installation. If housing 24(3) is a housing of a luminaire section, its light-emitting direction is ninety degrees different from that of luminaire section 20(7). FIG. 16 schematically illustrates a three way connector 63 connecting three luminaire sections 20. Three way connector 63 is functionally like connector 36 (e.g., both connectors 63 and 36 connect luminaire sections 20 that are oriented in the same light-emitting direction) but connector 63 uses rectilinear geometries instead of curving geometries.

Providing components for a lighting system with a curving or twisting modular housing generates certain new challenges for mechanical and electrical connectivity, some of which are now addressed.

In some embodiments, luminaire sections and/or connectors can be connected through the use of internal brackets that are not visible after the luminaire sections and/or connectors are connected. Other embodiments use a joiner that remains visible, and matches the profile of the luminaire sections and/or connectors that it joins, while it also aligns the luminaire sections in the axial direction.

Figure 17:
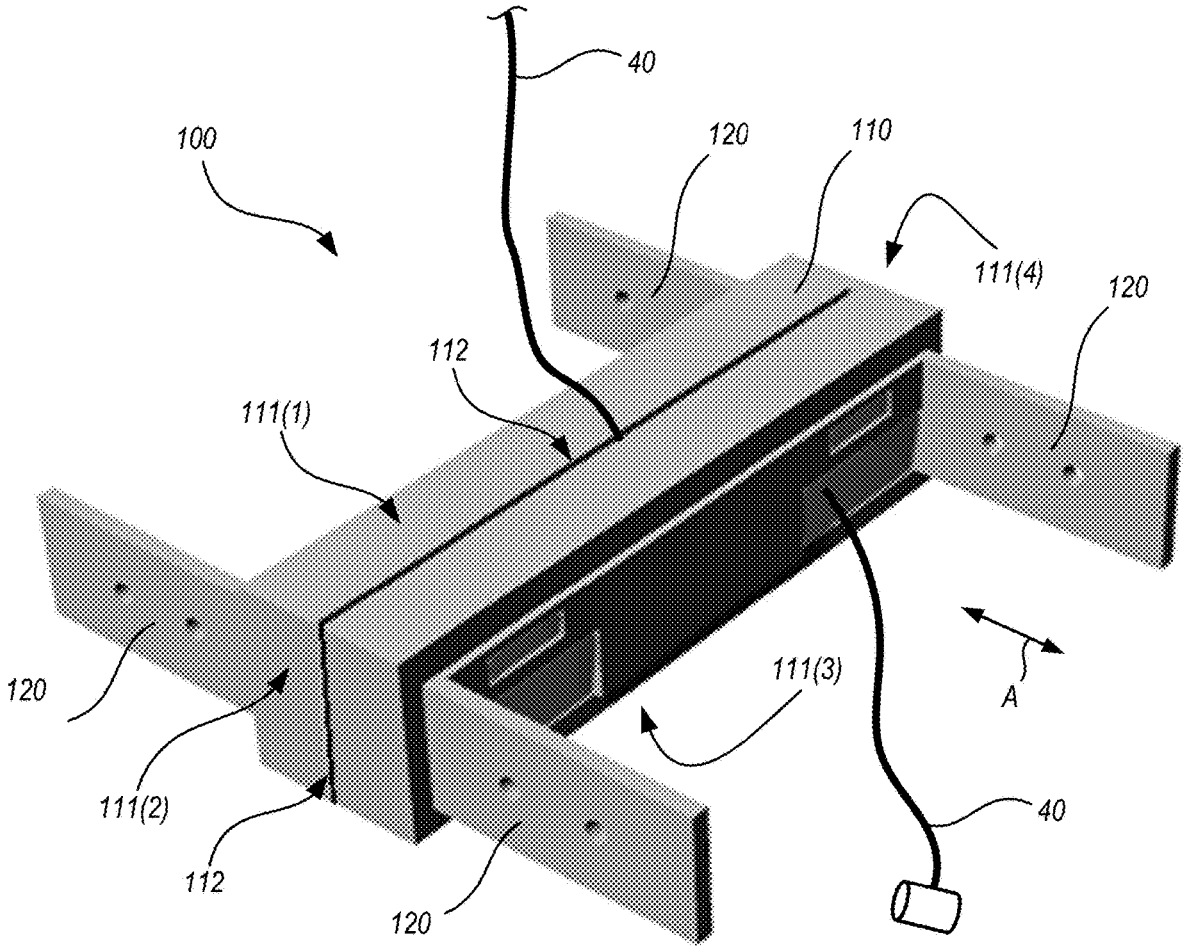
FIG. 17 illustrates a joiner that may be utilized to join luminaire sections, in accord with one or more embodiments.

Embodiments herein also include hardware for suspending the lighting systems disclosed herein, with optional flexibility to reposition and/or rotate the hardware about a point of suspension. FIG. 17 illustrates a hanger 100 that may be utilized to join luminaire sections 20, in accord with one or more embodiments. Hanger 100 includes a body portion 110 that forms four sides 111(1), 111(2), 111(3) and 111(4), and which may enclose or couple with further structural components of hanger 100. Sides 111(1), 111(2), 111(3) and 111(4) define a substantially rectangular profile as discussed herein, and can be configured to provide an exact match to the substantially rectangular profile of luminaire sections. FIG. 17 shows optional brackets 120 extending from body section 110. Optional brackets 120 are configured for insertion within luminaire sections 20, such that hanger 110 can act as a joiner for two luminaire sections, with ends of the luminaire sections abutting body section 110 to provide a finished look. That is, the visible cross-section of a system formed thereby will maintain visible continuity from each luminaire section 20, through body section 110 to the other luminaire section 20. Alternatively, hanger 100 can be integrated into a luminaire section itself, so that the luminaire section can be suspended without coupling first to a separate hanger or joiner.

At least one side 111 of body section 110 forms a slot 112 therethrough. In some embodiments, having slot 112 extend through at least portions of two adjoining sides 111 of body section 110, with slot 112 connecting through the corner formed by the adjoining sides, enables rotation of hanger 100 to accommodate installation or reconfiguration of an installed lighting system. A suspension cable 40 (e.g., as shown in FIG. 1) can pass through slot 112 within an upper surface of body section 110 such that a position of suspension cable 40 can be adjusted to balance the mechanical load supported thereby. A stopper end 42, however, is too large to pass through slot 112, so that hanger 100 and any luminaire section(s) attached thereto can be suspended from suspension cable 40. Cable 40 is inserted through open ends of body section 110 that are formed by sides 111(1), 111(2), 111(3) and 111(4). If brackets 120 are fixedly coupled so as to close both open ends of body section 110, at least one such bracket 120 may form a slot 122 that is large enough for stopper end 42 to pass through, so that body section 110 bears the weight of the installed lighting system.

The principles illustrated in FIG. 17 can also be utilized to form endcaps for luminaire sections, whereby the endcaps match the cross-section of an adjoining luminaire section where they meet. However, endcaps differ from joiners by providing a finished look to an end of a luminaire section by rounding off or otherwise terminating the cross-section in an aesthetically pleasing manner. Both endcaps and/or joiners can also provide functionality that may be addressed within a smaller linear footprint in the axial direction than typical luminaire sections. For example, endcaps and/or joiners can provide features such as sensors, loudspeakers, emergency lights, remote control receivers, mechanical mounting points (both to suspend the light fixture, and/or to suspend something from the light fixture) and the like.

Further construction details of hanger 100, and additional features that can enable balancing, leveling and/or multiple orientations, are provided in Appendix A of U.S. Provisional Patent Application No. 62/770,576, which is incorporated by reference herein.

In some embodiments, within the visual framework of a cross-sectional profile, some luminaire sections may be area (for example, Lambertian, but other area emitters are possible), spot, and/or line emitters. Luminaire sections may emit diffuse and/or directed light. Still other embodiments mount fixed or movable light emitters within a housing of a given cross-sectional profile, or may suspend fixed or movable light emitters from such a housing. These embodiments may include luminaires that provide two or more rails that circumscribe a cross-sectional profile that is identical to other luminaire sections and/or connectors of an installation, with fixed or movable light engines provided between, and/or suspended from, the two or more rails. In addition to movable light fixtures, adjustable or movable optics can be associated with light emitters so that light from the light engines can be redirected. This can be advantageous in that movable optics for redirecting light can often be generated with lower cost and better reliability than movable light engines. Adjustable or movable optics can be associated with either fixed or movable light fixtures. Availability of different luminaires that can provide various light types but all have the same cross-sectional profile can be thought of as enabling different "layers" of light while staying within a single visual form factor, which may be considered aesthetically pleasing. Providing light engines between and/or suspended from two or more rails may also assist in thermal dissipation, in that ambient air would be available to flow between the rails and/or around the light engines. This strategy may enable deployment of higher light power units than would otherwise be possible, due to limited heat dissipation. Connectors may also be fashioned with two or more rails to visually mimic luminaire sections that similarly have two or more rails. Further examples of luminaire sections with two or more rails that circumscribe the same form factor as other luminaires in the same installation, are provided in Appendix A of U.S. Provisional Patent Application No. 62/770,576, which is incorporated by reference herein.

Luminaire sections and/or connectors herein may be dimensioned so as to be readily installed with a ceiling or other mounting surface that presents mechanical and/or electrical support at specific intervals. Such intervals may be provided, for example, by 1'×1', 18"×18", 2'×2', 4'×4' and other grid type layouts. Examples of modular components dimensioned to couple with a standard mounting and/or power grid, are provided in Appendix A of U.S. Provisional Patent Application No. 62/770,576, which is incorporated by reference herein.

Figure 18A:
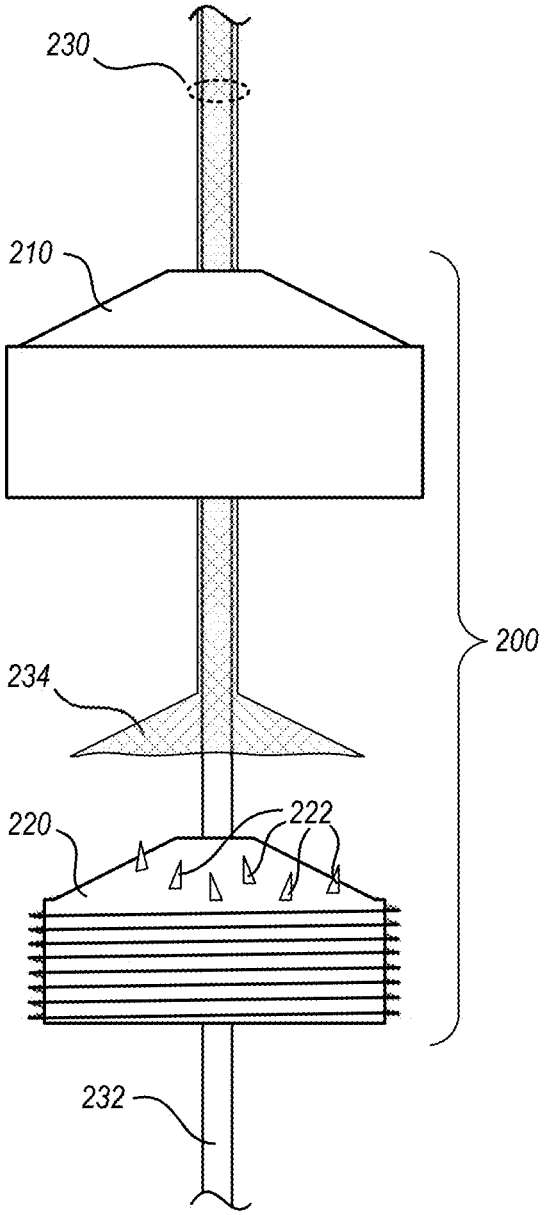
FIGS. 18A and 18B illustrate, in schematic exploded and cross-sectional views respectively, wiring and a finial apparatus that can be used to provide both mechanical support and electrical and/or signal connectivity to lighting systems herein, in accord with one or more embodiments.
Figure 18B:
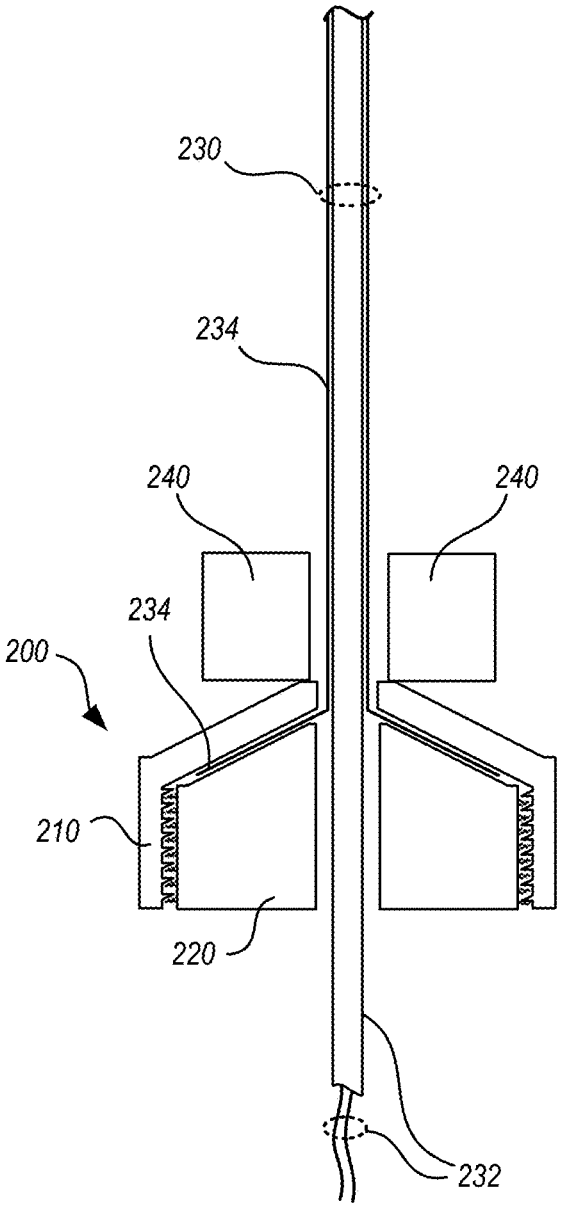

Lighting fixtures herein may utilize other novel strategies for providing mechanical support, power connectivity and/or signal connectivity. For example, FIGS. 18A and 18B illustrate, in schematic exploded and cross-sectional views respectively, wiring 230 and a finial apparatus 200 that can be used to provide both mechanical support and electrical and/or signal connectivity to lighting systems herein. Wiring 230 includes inner wiring 232 and an outer jacket 234. Inner wiring 232 may include conductors to provide electrical power to a lighting system, control wiring, and/or other forms of connectivity (e.g., fiber optics), which all may be denoted as "wires" herein, despite some of them not being physical wires. Inner wiring 232 may include individual loose (e.g., mechanically independent) wires, and may optionally include a sheath that encloses such wires, as illustrated in FIG. 18B. Outer jacket 234 is mechanically strong so as to be capable of supporting the weight of light fixtures herein. Outer jacket 234 can encase, but is not rigidly attached to, inner wiring 232. Outer jacket 234 is capable of being physically separated from, and flared away from (or otherwise made mechanically separate from) inner wiring 232. In one example, outer jacket 234 is a braided wire sheath, which may be particularly advantageous because a braided wire or other conductor used as outer jacket 234 can shield inner wiring 232 from being subject to, and/or emitting, electromagnetic interference. In this example, outer jacket 234 can be partially pulled apart into a flared end that attaches mechanically to finial 200, while inner wiring 232 passes through to a fixture beneath.

Finial 200 is capable of attaching to outer jacket 234 so as to transmit weight of a load 240 (e.g., a luminaire section or other component) through outer jacket 234, without subjecting inner wiring 232 to the weight. For example, it should be understood that load 240 is represented schematically only as resting upon an upper surface of upper member 210, but other modes of transferring weight of a load to finial 200 are possible. In the embodiment illustrated in FIGS. 18A and 18B, finial 200 includes an upper member 210 and a lower member 220 that attach to outer jacket 234 by screwing together with one another, with a flared end of outer jacket 234 trapped therebetween. Either upper member 210 and/or lower member 220 may form retention features 222 to help finial 200 couple mechanically with outer jacket 234. In FIG. 18A, retention features 222 are illustrated as small spikes on a surface of lower member 220, but other raised and/or depressed such as ridges, dimples, spiral features (that, optionally, run opposite to the direction of threads connecting upper member 210 with lower member 220) and more are possible. It is also possible to form one or more coupling features for outer jacket 234 as portions of either upper member 210 or lower member 220 alone. In such cases, outer jacket 234 can couple directly to the member that forms the coupling feature(s), and then the lower member can couple with the upper member without affecting the coupling of outer jacket 234. In certain embodiments, finial 200 can be deployed such that load 240 rests solely atop final 200, as shown in FIG. 18B, or finial 200 can be deployed within a component such as a luminaire section, a connector or a joiner section as disclosed herein, so that finial 200 is surrounded by the component, and not visible after installation. Also, in certain embodiments, finial 200 can be integrated with such a component. That is, a luminaire section, a connector or a joiner section can form one of upper member 210 and/or lower member 220, such that when connected, the weights of the component and/or other components with which the component is connected, can all transfer to outer jacket 234.

Although finial 200 is illustrated in FIGS. 18A, 18B as having a generally cylindrical shape with a truncated conical upper surface, it is understood that this is for illustrative purposes only, and finial 200 may have any other convenient shape. Similarly, although lower member 220 is illustrated as screwing into upper member 210, other modalities of coupling lower member 220 with upper member 210 so as to couple outer jacket 234 with finial 200 are also possible. It should also be understood from FIG. 18B that when outer jacket 234 is coupled with finial 200, apertures formed by upper member 210 and lower member 220 align, so that finial 200 and outer jacket 234 may form a continuous aperture extending within outer jacket 234 above finial 200, through upper member 210 and lower member 220, to an opposite side of finial 200. Thus, the possibility exists that outer jacket 234 can couple with finial 200 before inner wiring 232 is present, and inner wiring 232 can be added later, or omitted when not needed (e.g., when only mechanical connectivity, but not signal or power connectivity, is needed).

Figure 19:
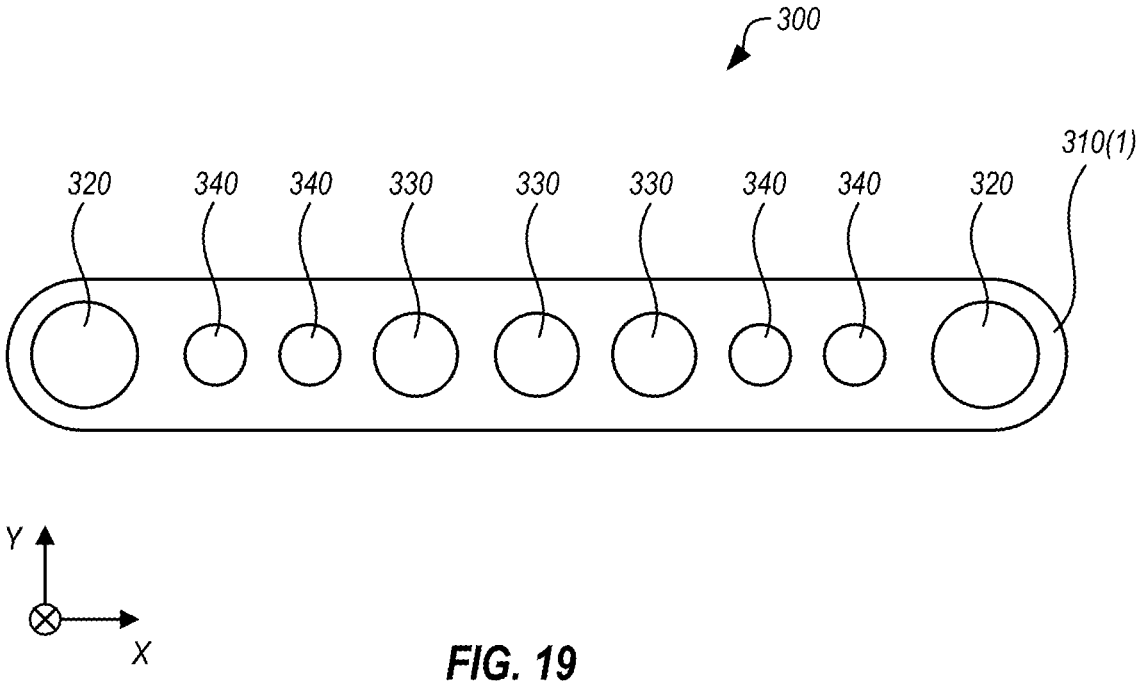
FIG. 19 illustrates, in a schematic cross-sectional view, a ribbon cable that provides mechanical support and electrical and/or signal connectivity to lighting systems herein, in accord with one or more embodiments.

Other novel strategies for providing mechanical support, power connectivity and/or signal connectivity are possible. For example, FIG. 19 illustrates, in a schematic cross-sectional view, a ribbon cable 300 that provides mechanical support and electrical and/or signal connectivity to lighting systems herein. Ribbon cable 300 may be considered more aesthetically pleasing than separate mechanical and/or electrical connectors, and especially more pleasing than multiple mechanical and/or electrical connectors, when used with lighting systems herein. This is due to ribbon cable 300 visually mimicking, or at least approximating, the visual form factor of the luminaire sections, connectors, joiners and the like disclosed elsewhere herein, and simplifying mechanical and electrical interfaces of such apparatus from separate mechanical and/or electrical wires, cables and the like, to a single component.

Ribbon cable 300 includes an outer jacket 310(1) that encases and stabilizes mechanical support features such as cables, and electrical and/or other (e.g., fiber optic) wires. Thus, in embodiments, a single ribbon cable 300 may be able to provide all of the mechanical support, power and control functionality to light fixtures described herein (or any light fixtures). Alternatively, a ribbon cable 300 may provide only such support and/or functionality for one portion of a luminaire, while other ribbon or standard wires or cables provide support and/or functionality to other portions of the luminaire. Ribbon cable 300 also includes, for example, cables 320 that can provide mechanical support, and wires 330 and 340 that provide power and/or controls, for a light fixture. In certain embodiments, cables 320 may be ⅛ inch woven or twisted steel cable, and are disposed outwardly of other wires within cable 300 (e.g., at the greatest and least values of the X axis shown in FIG. 19) to provide stability and/or protection for wires 330 and 340. Wires 330 may be heavy gauge (e.g., 12- to 16-gauge) wire of copper or other good electrical conductor to provide power and ground functionality for a light fixture. Wires 340 may be lighter gauge (e.g., 18- to 24-gauge) wire, or other media such as fiber optic, to provide control functionality for a light fixture. Material of jacket 310 may be chosen for qualities such as insulation, pliability, durability, moldability and the like. Although two cables 320, three wires 330 and four wires 340 are illustrated in FIG. 19, other multiples of cables and wires are contemplated. Specific combinations that are useful include at least one cable and two wires, at least one cable and three wires, at least one cable and four wires, at least two cables and two wires, at least two cables and three wires, and at least two cables and four wires.

Figure 20:
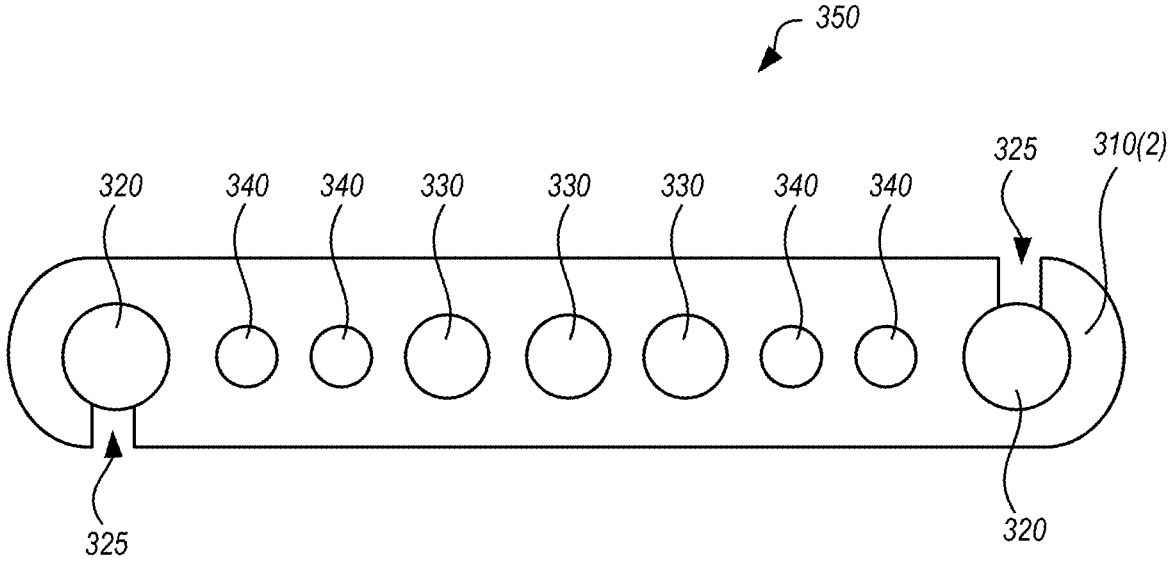
FIG. 20 illustrates, in a schematic cross-sectional view, a ribbon cable that provides mechanical support and electrical and/or signal connectivity to lighting systems herein, in accord with one or more embodiments.

In another example, FIG. 20 illustrates, in a schematic cross-sectional view, a ribbon cable 350 that provides mechanical support and electrical and/or signal connectivity to lighting systems herein. Ribbon cable 350 is similar to ribbon cable 300, except that cables 320 are not fully enclosed within jacket 310(2). Instead, cables 320 occupy recesses 325 within jacket 310(2). Constructed in this way, ribbon cable 350 enables installation of a light fixture by hanging it by cables 320 first, then installing ribbon cable 350 by pushing cables 320 into recesses 325, then connecting wires 330 and/or 340 with circuitry of the light fixture, as needed. This allows the connections of wires 330 and/or 340 to be made without concern for simultaneously managing transfer of a light fixture's weight to cable 350. Anyone who has ever installed a light fixture by connecting wires, before affixing the light fixture to support structure, will immediately understand the benefit thereof.

Further modifications of cables 300 and/or 350 to facilitate installation are also possible. For example, Appendix A of U.S. Provisional Patent Application No. 62/770,576, which is incorporated herein by reference, discloses cables that form "clamshell" and "zipper" structures about a suspension cable. In each case, the cables include wiring for power and/or signal connectivity, within a jacket that can be placed about a previously installed suspension cable. In such cases, again, a light fixture can be mechanically installed by connecting the suspension cable, then adding the cable that includes the power and/or signal connectivity.

It is to be understood that the types and placement of components within ribbon cables 300 and 350 as described above and in Appendix A of U.S. Provisional Patent Application No. 62/770,576 are exemplary only, and such components can be changed in number, type or position as needed. For example, when more cables or wires are required for a given application, they can be oriented in a single line as shown in cables 300 and 350, or in multiple rows as needed (e.g., multiple rows in the Y direction shown in FIG. 19). Cables 320 are advantageously distributed symmetrically and/or to outside edges so as to provide stability and/or protection for other components. Specific placement of wires 330 and 340 within jackets 310 may not be critical, although symmetric layout may be desirable for moldability and/or aesthetic appearance. Recesses 325 may be provided at any convenient location within jackets 310 as desired to facilitate manufacturing and/or installation of ribbon cables and light fixtures herein.

Further examples of ribbon cables and/or zipper type cables, are provided in Appendix A of U.S. Provisional Patent Application No. 62/770,576, which is incorporated herein by reference.

Figure 21:
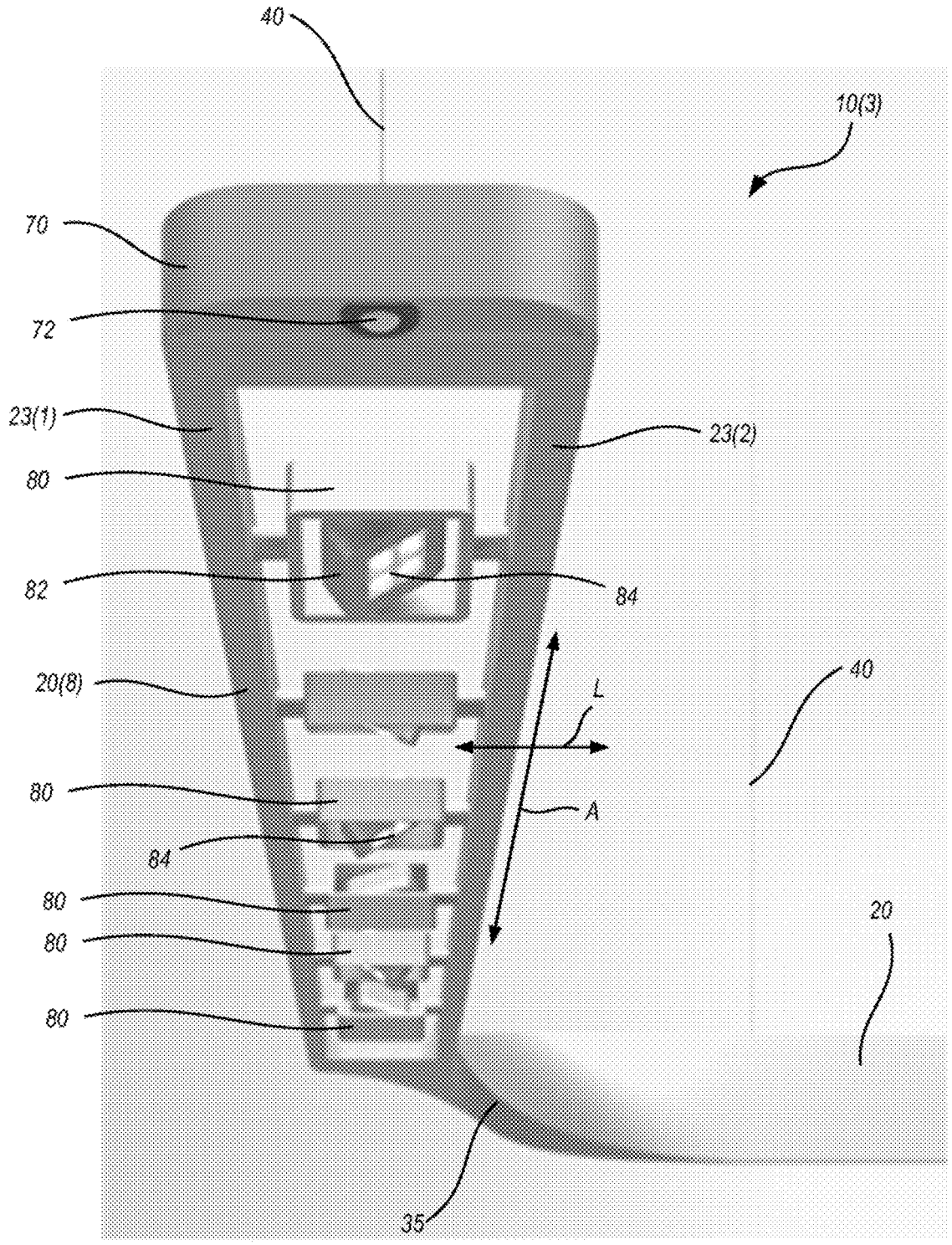
FIG. 21 schematically illustrates a lighting system that includes a luminaire section, a connector, and a second luminaire section, in accord with one or more embodiments.

FIG. 21 schematically illustrates a lighting system 10(3) that includes a luminaire section 20(8), a connector 35 as discussed above, and a second luminaire section 20. Lighting system 10(3) is suspended at least by suspension cables 40 as shown, and may be coupled with other components that are also suspended or otherwise mechanically supported. Luminaire section 20(8) can be provided with a substantially rectangular cross-section as discussed above, so as to match other components of the lighting system for aesthetic appeal. Luminaire section 20(8) includes rail members 23(1), 23(2) that extend parallel with one another along axial direction A, and separated by a lateral distance along a lateral direction L, as shown. Rail members 23(1), 23(2) define the substantially rectangular cross-section, and can provide electrical wiring for power or control for lighting modules 84 of luminaire section 20(8). First and second ends of both rail members 23(1), 23(2) are joined so as to form the complete luminaire section 20(8).

Lighting modules 84 are mounted within rotatable mounts such that at a home position, all portions of luminaire section 20(8) are within the substantially rectangular cross-section, but when rotated, may extend from it. For example, first mounts 80 couple with one or both of rail members 23(1), 23(2), and can rotate such that the light from a lighting module 84 within mount 80 essentially sweeps along axial direction A; this can include rotating upwardly so that lighting module 84 provides uplight. Second mounts 82 can also be provided, each mounted within a corresponding first mount 80. Second mounts 82 can rotate such that the light from a lighting module 84 within a mount 82 essentially sweeps across a lateral direction L; this can also include rotating upwardly so that lighting module 84 provides uplight.

FIG. 21 also schematically illustrates an endcap 70 that may be utilized with lighting systems herein. Endcap 70 provides a clean finished look and can provide a housing for components that may be occasionally used in connection with lighting systems. For example, endcap 70 as shown in FIG. 21 includes a sensor 72 (which may be a light sensor, motion sensor or any other type of sensor) and an anchoring point for a suspension cable 40.

Innovations in light fixtures themselves are also illustrated in Appendix A of U.S. Provisional Patent Application No. 62/770,576, which is incorporated herein by reference. For example, in light fixtures as contemplated herein, electrical power and/or signal connectivity may need to pass through successive luminaire sections, joiners, hangers, and connectors within a given installation. Thus, certain wires may run the length of luminaire sections in parallel with lighting components in a slim form factor, such that space is at a premium. In certain embodiments, this problem is addressed by providing a bracket on one side of a light fixture that holds insulated wires securely in place at known locations, with a mounting bracket that has latching features. Then, a printed circuit board ("PCB") that provides the lighting components, is provided that can simultaneously (1) latch into the latching features of the bracket, and (2) use sharp features placed at precise locations on the back of the PCB, to slice through the insulation, and provide connectivity for the lighting components on the PCB, to the insulated wires. The structure disclosed also minimizes assembly cost and maximizes flexibility by allowing structures that bear wires to be manufactured ahead of time without respect to application, that can later be mated with PCBs to provide various forms of electrical or optical output as desired. The final installation of the PCB to the luminaire section can also be performed without tools, by simply pressing the PCB into the latching features.

In another innovation to cope with the limited space available in slim profile luminaire sections, light-emitting diodes ("LEDs") emit from a PCB into a light guide. Extraction and/or scattering features within or on surfaces of the light guide, and further optics (e.g., reflectors or refractive films) behind or in front of the light guide, can be used to provide a variety of light distributions from the luminaire section.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

What is claimed is:

1. A lighting system, comprising:

a first component coupled with a first housing, wherein:

the first housing defines a first substantially rectangular cross-section that extends, linearly and without rotating, along a first axial direction from a first end of the first housing to a second end of the first housing, the first axial direction being transverse to the first substantially rectangular cross-section, and the first component is capable of emitting light;

a second component coupled with a second housing, wherein:

the second housing defines a second substantially rectangular cross-section that is substantially identical to the first substantially rectangular cross-section;

the second substantially rectangular cross-section extends, linearly and without rotating, along a second axial direction from a first end of the second housing to a second end of the second housing, the second axial direction being transverse to the second substantially rectangular cross-section; and a connector that connects the second end of the first housing with the first end of the second housing, wherein:

the connector defines a third substantially rectangular cross-section that is substantially identical to the first substantially rectangular cross-section such that the first housing, the second housing, and the connector provide a visual impression of being a single unit, the third substantially rectangular cross-section extends along a path from the second end of the first housing to the first end of the second housing, wherein the third substantially rectangular cross-section rotates at least fifteen degrees about a length of the path, the first component includes one or more light emitters that couple the light into a light guide, the light guide contains the light by total internal reflection until light extracting elements scatter the light out of the light guide, and the light guide emits the light through an aperture formed in a face of the first housing that extends along one of two opposing longer segments of the first substantially rectangular cross-section.

2. The lighting system of claim 1, wherein the path includes at least one curve of at least fifteen degrees between the second end of the first housing and the first end of the second housing.

3. The lighting system of claim 1, wherein the first housing is oriented such that two opposing longer segments of the first substantially rectangular cross-section are within fifteen degrees of vertical.

4. The lighting system of claim 1, wherein the one or more light emitters are a row of LED chips that emit the light into an edge of the light guide.

5. The lighting system of claim 1, wherein the light is directed into an outward and downward distribution that is centered within an angular range between 55 degrees and 75 degrees below horizon.

6. The lighting system of claim 1, wherein the first housing is oriented such that two opposing longer segments of the first substantially rectangular cross-section are within fifteen degrees of horizontal.

7. The lighting system of claim 1, wherein:

the first component emits a first portion of the light through an aperture formed in a face of the first housing that extends along one of two opposing longer segments of the first substantially rectangular cross-section;

the first component includes one or more first light emitters that couple the first portion of the light into a light guide, and the light guide emits the light downwardly through the aperture;

the lighting system further comprises a second component coupled with the first housing; and the second component includes one or more second light emitters that emit a second portion of the light; and the second portion of the light is emitted upwardly.

8. The lighting system of claim 7, wherein the second light emitters are a row of LEDs extending in the first axial direction, and further comprising a linear lens that extends along the first axial direction and substantially redirects the second portion of the light into two lobes that emit upwardly and outwardly away from one another, with a light minimum between the two lobes.

9. The lighting system of claim 1, wherein:

the first housing comprises one or more suspension points; and the second housing comprises one or more suspension points;

and wherein:

each of the suspension points comprises structure capable of supporting a substantial portion of a weight of the corresponding housing;

any two of the suspension points that are separated from one another in the first axial direction, are separated by integral multiples of one foot in the first axial direction; and any two of the suspension points that are separated from one another in the second axial direction, are separated by integral multiples of one foot in the second axial direction.

10. The lighting system of claim 1, wherein each face of the third substantially rectangular cross-section is non-planar along a length of the rotation.

11. A lighting system, comprising:

a first component coupled with a first housing, wherein:

the first housing defines a first substantially rectangular cross-section that extends, linearly and without rotating, along a first axial direction from a first end of the first housing to a second end of the first housing, the first axial direction being transverse to the first substantially rectangular cross-section; and the first component is capable of emitting light;

a second component coupled with a second housing, wherein:

the second housing defines a second substantially rectangular cross-section that is substantially identical to the first substantially rectangular cross-section; and the second substantially rectangular cross-section extends, linearly and without rotating, along a second axial direction from a first end of the second housing to a second end of the second housing, the second axial direction being transverse to the second substantially rectangular cross-section; and a connector that connects the second end of the first housing with the first end of the second housing, wherein:

the connector defines a third substantially rectangular cross-section that is substantially identical to the first substantially rectangular cross-section such that the first housing, the second housing, and the connector provide a visual impression of being a single unit;

the third substantially rectangular cross-section extends along a path from the second end of the first housing to the first end of the second housing, wherein the path includes at least one curve of at least fifteen degrees between the second end of the first housing and the first end of the second housing; and the at least one curve in the path generates a shape in the connector such that:

opposing wider faces of the connector curve so as to make one of the wider faces longer than the other;

opposing shorter faces of the connector curve, but are the same length as one another;

the first component includes one or more light emitters that couple the light into a light guide;

the light guide contains the light by total internal reflection until light extracting elements scatter the light out of the light guide; and the light guide emits the light through an aperture formed in a face of the first housing that extends along one of two opposing longer segments of the first substantially rectangular cross-section.

12. The lighting system of claim 11, wherein the first housing is oriented such that two opposing longer segments of the first substantially rectangular cross-section are within fifteen degrees of vertical.

13. The lighting system of claim 11, wherein the one or more light emitters are a row of LED chips that emit the light into an edge of the light guide.

14. The lighting system of claim 11, wherein the light is directed into an outward and downward distribution that is centered within an angular range between 55 degrees and 75 degrees below horizon.

15. The lighting system of claim 11, wherein the first housing is oriented such that two opposing longer segments of the first substantially rectangular cross-section are within fifteen degrees of horizontal.

16. The lighting system of claim 11, wherein:

the first component emits a first portion of the light through an aperture formed in a face of the first housing that extends along one of two opposing longer segments of the first substantially rectangular cross-section;

the first component includes one or more first light emitters that couple the first portion of the light into a light guide, and the light guide emits the light downwardly through the aperture;

the lighting system further comprises a second component coupled with the first housing; and the second component includes one or more second light emitters that emit a second portion of the light; and the second portion of the light is emitted upwardly.

17. The lighting system of claim 16, wherein the second light emitters are a row of LEDs extending in the first axial direction, and further comprising a linear lens that extends along the first axial direction and substantially redirects the second portion of the light into two lobes that emit upwardly and outwardly away from one another, with a light minimum between the two lobes.

18. The lighting system of claim 11, wherein:

the first housing comprises one or more suspension points; and the second housing comprises one or more suspension points;

and wherein:

each of the suspension points comprises structure capable of supporting a substantial portion of a weight of the corresponding housing;

any two of the suspension points that are separated from one another in the first axial direction, are separated by integral multiples of one foot in the first axial direction; and any two of the suspension points that are separated from one another in the second axial direction, are separated by integral multiples of one foot in the second axial direction.

* * * * *